US011823881B2

(12) United States Patent
Laktineh

(10) Patent No.: US 11,823,881 B2
(45) Date of Patent: Nov. 21, 2023

(54) ELEMENTARY PARTICLE DETECTOR

(71) Applicants: UNIVERSITÉ CLAUDE BERNARD LYON 1, Villeurbanne (FR); CENTRE NATIONAL DE LA RECHERCHE SCIENTIFIQUE, Paris (FR)

(72) Inventor: Imad Laktineh, Thil (FR)

(73) Assignees: UNIVERSITE CLAUDE BERNARD LYON 1, Villeurbanne (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 316 days.

(21) Appl. No.: 17/423,723

(22) PCT Filed: Jan. 16, 2020

(86) PCT No.: PCT/FR2020/050058
§ 371 (c)(1),
(2) Date: Jul. 16, 2021

(87) PCT Pub. No.: WO2020/148508
PCT Pub. Date: Jul. 23, 2020

(65) Prior Publication Data

US 2022/0082709 A1 Mar. 17, 2022

(30) Foreign Application Priority Data

Jan. 18, 2019 (FR) ..... 1900458

(51) Int. Cl.
*H01J 43/24* (2006.01)

(52) U.S. Cl.
CPC ..... *H01J 43/246* (2013.01)

(58) Field of Classification Search
CPC ..... H01J 43/246; H01J 43/30
See application file for complete search history.

(56) References Cited

U.S. PATENT DOCUMENTS

| | | | | |
|---|---|---|---|---|
| 6,384,519 | B1 | 5/2002 | Beetz et al. | |
| 11,011,358 | B2 * | 5/2021 | Masuko | H01J 43/246 |
| 2003/0111597 | A1 | 6/2003 | Gonin et al. | |
| 2016/0111267 | A1 | 4/2016 | Kholomeev et al. | |

FOREIGN PATENT DOCUMENTS

FR 3062926 A1 8/2018

OTHER PUBLICATIONS

International Search Report and Written Opinion received for PCT/FR2020/050058, dated Jun. 2, 2020.
French Search Report received for FR1900458, dated Nov. 7, 2019.

* cited by examiner

*Primary Examiner* — Karabi Guharay
(74) *Attorney, Agent, or Firm* — Greer, Burns & Crain, Ltd.

(57) ABSTRACT

An elementary particle detector including first sensors able to measure an amount of electric charge on electrodes of a readout plate and a processing unit able to determine the location of an avalanche of secondary electrons from the amount of electric charge measured by the first sensors and from the known location of the electrodes. The detector also includes at least one second sensor, each second sensor being able to measure an electrical signal produced by the secondary electrons when they pass through a conductive gate. The processing unit is additionally able to establish an arrival time of the elementary particle from a time at which the electrical signal is measured by the second sensor.

11 Claims, 3 Drawing Sheets

ELEMENTARY PARTICLE DETECTOR

BACKGROUND

The invention relates to an elementary particle detector and a method for detecting elementary particles. The invention also relates to an information recording medium for the implementation of this method for detecting elementary particles.

Known detectors of elementary particles comprise:

- a cathode and a conducting grid intended to create a potential difference capable of accelerating electrons in the direction of the conducting grid, the conducting grid being able to be traversed by the accelerated electrons,
- a dynode interposed between the cathode and the conducting grid, this dynode being able to produce, for each elementary particle, an avalanche of secondary electrons, this dynode comprising for this purpose several channels, each channel comprising an emissive material, this emissive material being capable, in response to an impact of an electron, of generating, on average, more than one secondary electron,
- a reader plate arranged on the side of the conducting grid opposite to the dynode, this reader plate comprising:
  - an external face arranged in such a manner as to be impacted by the avalanche of secondary electrons, and
  - electrodes arranged next to one another in a face parallel to or coinciding with the external face,
- first sensors able to measure the quantity of electrical charges on the electrodes,
- a processing unit able to determine the location of the avalanche of electrons based on the quantity of electrical charges measured by the first sensors and based on the known location of the electrodes.

For example, such an elementary particle detector is known from the U.S. Pat. No. 6,384,519B1.

Such detectors operate correctly for determining a position of the point of impact of the elementary particle and a time of arrival of this elementary particle. However, it is desirable to improve the precision of the measurement of this position and/or of the time of arrival.

SUMMARY

The invention is therefore aimed at providing an elementary particle detector in which the precision of the measurement of the position of the point of impact and/or the precision of the measurement of the time of arrival of the elementary particle are improved.

Lastly, another subject of the invention is an information recording medium, readable by an electronic computer, this recording medium comprising instructions for the execution of the method for detecting elementary particles, when these instructions are executed by the electronic computer.

BRIEF DESCRIPTION OF THE DRAWINGS

The invention will be better understood upon reading the description that follows, given solely by way of non-limiting example and presented with reference to the drawings, in which.

DETAILED DESCRPITION

In these figures, the same references are used for denoting the same elements. In the following part of this description, the features and functions well known to those skilled in the art are not described in detail.

CHAPTER I: EXAMPLES OF EMBODIMENTS

Figure 1:
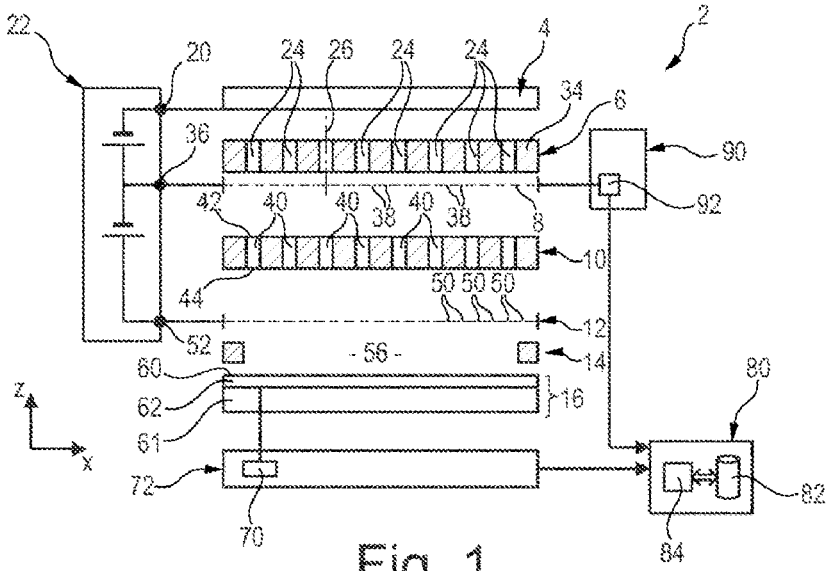
FIG. 1 is a schematic illustration, in vertical cross section, of a first embodiment of an elementary particle detector.

FIG. 1 shows a detector 2 of elementary particles. The detector 2 is a detector known by the term "MicroChannel Plate Detector". In this embodiment, the elementary particles to be detected are photons.

The general architecture and the principle of operation of such a detector are known. For example, the reader may be referred to the U.S. Pat. No. 6,384,519B1. Thus, in the following, only the details necessary for understanding the invention are described in detail.

In this application, figures are oriented with respect to an orthogonal reference frame XYZ, where Z is the vertical direction which points upward. The terms such as "upper", "lower", "high", "low", "top", "bottom", "above" and "below" are defined with respect to the direction Z.

The detector 2 comprises, successively going from top to bottom, the following different elements:

- a cathode 4,
- an upper dynode 6,
- an upper conducting grid 8,
- a lower dynode 10,
- a lower conducting grid 12,
- a spacer 14, and
- a reader plate 16.

These various elements each essentially extend in a horizontal plane. Their width is therefore much greater than their height. They are also directly stacked on top of one another. However, in order to enhance the readability of FIG. 1, in this figure, these various elements are vertically spaced from one another.

The cathode 4 is made from a material which is also electrically conducting or resistive. The cathode 4 is connected to a terminal 20 of a power source 22 which delivers a potential HV1. The cathode 4 is generally made of an emissive material which generates at least one electron when an elementary particle strikes it. In the particular case where the elementary particle is a photon, this cathode is known by the term "photocathode".

Here, "electrically-conductive material" or "conducting material" denotes a material whose resistivity at 20° C. is less than $10^{-2}$ Ω·m and, preferably, less than $10^{-5}$ Ω·m or $10^{-6}$ Ω·m. Generally speaking, the resistivity of an electrically-conductive material at 20° C. is greater than $10^{-10}$ Ω·m.

Here, "electrically-resistive material" or "resistive material" denotes a material whose resistivity at 20° C. is less than $10^{12}$ Ω·m and, preferably, less than $10^{6}$ Ω·m or $10^{4}$ Ω·m.

The dynode 6 is situated just under the cathode 4. The dynode 6 is a micro-channel plate known by the acronym MCP. It is traversed vertically, from one end to the other, by several million channels often called "microchannels". In FIG. 1, only a few channels 24 are shown schematically. In this embodiment, each channel extends along a vertical axis 26.

The density of the channels 24 per unit of horizontal surface area is typically greater than a thousand channels per square centimeter or 10 000 channels per square centimeter or 100 000 channels per square centimeter. Here, the density of channels per square centimeter is very high. For example, this density is greater than 1 million channels per square centimeter or greater than 3 million channels per square centimeter. For this purpose, the average diameter Dm24 of the channels 24 is very small, in other words, generally less than 100 μm or 50 μm or 10 μm. This diameter Dm24 is also usually greater than 10 nm or 50 nm.

"Average diameter" denotes the unweighted or arithmetic average diameters of all the transverse cross sections of the channel 24 along its axis 26. The transverse cross sections are horizontal. In addition, when the transverse cross section of the channel 24 is not circular, the term "diameter" denotes the hydraulic diameter of this transverse cross section.

Here, the transverse cross section of the channel 24 is circular. In addition, this transverse cross section is constant over the entire length of the channel 24. The length of the channel 24 in the direction Z is conventionally greater than its diameter Dm24 or than 2*Dm24 or than 10*Dm24. In this description, the symbol "*" denotes the multiplication operation. This length is also usually less than 500*Dm24 or 100*Dm24 or 50*Dm24.

The shortest horizontal distance that separates the axes 26 of two channels 24 situated next to each other is usually less than 4*Dm24 or 2*Dm24.

Each channel 24 comprises:

- an entry 28 (FIG. 2) via which the electrons to be amplified penetrate inside the channel 24, and
- an exit 30 (FIG. 2) via which the amplified electrons escape from the channel 24.

Figure 2:
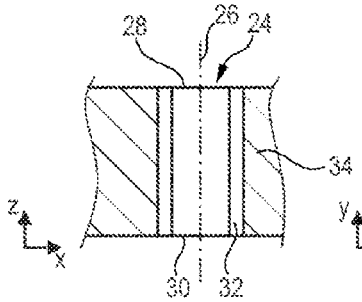
FIG. 2 is a partial schematic illustration, in vertical cross section, of one channel of a dynode of the detector in FIG. 1.

At least the upper part of the vertical walls of the channel 24 is composed of an emissive coating 32 (FIG. 2). When the coating 32 only forms a part of the vertical wall of the channel 24, it typically forms more than a quarter or more than a third of the height of this vertical wall. Here, the emissive coating 32 extends over the entire length of the channel 24.

The coating 32 is made of an emissive material which, on average, when it is impacted by one electron, in response generates more than one secondary electron and preferably more than 1.5 or 2 secondary electrons. For example, the emissive material used to form the coating 32 is chosen within the group consisting of the emissive materials listed between the rows 6 to 44 of the column 10 of U.S. Pat. No. 6,384,519B1.

Aside from the channels 24 and from the coatings 32, the dynode 6 comprises a matrix 34 within which these channels 24 are formed. The matrix 34 may be composed of a resistive material or a dielectric material. Here, "dielectric material" denotes a material whose resistivity at 20° C. is higher than or equal to $10^{12}$ Ω·m and, preferably, higher than or equal to $10^{14}$ Ω·m or $10^{16}$ Ω·m. Generally speaking, the resistivity of a dielectric material at 20° C. is less than $10^{28}$ Ω·m. A resistive material is a material whose resistivity is in the range between those of dielectric materials and of conductive materials.

The grid 8 in combination with the cathode 4 generates an electric field able to accelerate downward the electrons situated and generated inside of each of the channels 24. For example, the electric field generated is in the range between 1 kV/cm and 50 kV/cm.

For this purpose, the grid 8 is made of a conductive material, such as a metal. It is connected to a terminal 36 of the source 22 which delivers a potential HV2 higher than the potential HV1. The difference between the potentials HV1 and HV2 is, for example, higher than 10 Volts or 100 Volts and, generally, less than 5000 Volts or 2000 Volts.

The grid 8 is also, as far as possible, transparent to the electrons accelerated and expelled via the exits 30 of the channels 24. Such a grid is known as a "Frisch grid".

The transparency of a conducting grid is defined as being the value, expressed in %, of the ratio between the number of electrons passing through this grid divided by the number of electrons projected onto this grid. This transparency is generally in the range between 30% and 95% or between 45% and 90%. For example, here, it is greater than 60% or 70%.

For this purpose, the grid 8 is penetrated by a multitude of small holes 38, only a small number of which is shown schematically in FIG. 1. Typically, the diameter D38 of the holes 38 is less than 50 μm or 100 μm. In order to obtain a high transparency, the cumulation of the surface areas of the transverse cross sections of the holes 38 represents more than 30% or 45% and, preferably, more than 60% or 70% of the smallest surface area of the conducting grid containing all these holes 38.

Typically, the thickness of the grid 8 is small compared to the diameter D38 of the holes, in other words the thickness of the grid is generally less than the diameter D38 or than 0.5*D38.

The impedance of the grid 8 is uniform. For example, here, it is considered that the impedance of the grid is uniform if the impedance between any two points A and B of the grid 8, horizontally spaced from one another by a constant horizontal distance, is systematically in the range between $0.95Z_{AB}$ and $1.05Z_{AB}$ irrespective of the chosen horizontal distance, where $Z_{AB}$ is a constant.

The dynode 10 is identical to the dynode 6 except that:

- the channels, the entries and the exits of these channels carry, respectively, the numerical references 40, 42 and 44, and the diameter Dm40 of these channels 40 is different from the diameter Dm24.

The dynode 10 is positioned with respect to the dynode 6 in such a manner that the electrons that escape from the exit 30 of a channel 24 are distributed into several channels 40. For example, for this purpose, the orthogonal projection onto a horizontal plane containing the entries 42 of the transverse cross section of the exit 30 of each channel 24 covers, at least partially, at least two entries 42. By virtue of this, the electrons that escape from the exit 30 are distributed into several of the channels 40 of the dynode 10.

Figure 3:
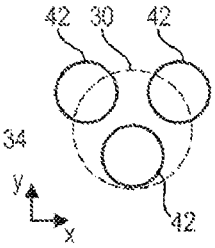
FIGS. 3 and 4 are schematic illustrations of various possible positionings of the channels of an upper dynode with respect to the channels of a lower dynode in a detector such as the detector in FIG. 1.

For this purpose, in a first embodiment, the diameter Dm40 is less than the diameter Dm24 and, preferably, less than 0.8*Dm24 or than 0.5*Dm24. This embodiment is illustrated in FIG. 3. In this figure, the orthogonal projection of the exit 30 of a channel 24 in the horizontal plane containing the entries 42 is represented by a dashed circle which carries the same reference as the exit 30.

Figure 4:
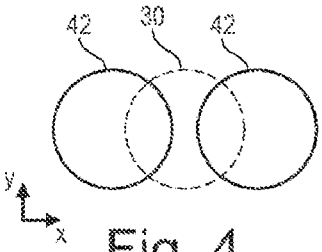

In another embodiment, the diameter Dm40 is equal to or greater than the diameter Dm24. In this case, the channels 40 are offset horizontally with respect to the channels 24. By way of illustration, this is shown in FIG. 4 in the particular case where the diameters Dm40 and Dm24 are equal.

The grid 12 is identical to the grid 8, except that the holes carry the numerical references 50. In addition, the diameter D50 of the holes 50 is not necessarily equal to the diameter D38. Indeed, if necessary, it is adapted so as to obtain a transparency higher than 60% or 80%. For example, the diameter D50 is adapted as a function of the diameter Dm40.

The grid 12 is connected to a terminal 52 of the source 22 which generates a potential HV3. The potential HV3 is higher than the potential HV2 so as to create an electric field in the channels 40 which allows the secondary electrons to be accelerated toward the grid 12. For example, the potential HV3 is adjusted so as to generate an electric field identical to that generated in the channels 24.

The spacer 14 separates the dynode 10 from the reader plate 16. More precisely, it forms an empty space 56 between the exits 42 of the channels 40 and an external horizontal face 60 of the plate 16. This empty space 56 is crossed by the avalanche of secondary electrons which emerge from the exits 44 of the dynode 10 when an elementary particle is detected. This space 56 increases the spatial dispersion of these secondary electrons, in particular, in the horizontal direction. Thus, the surface area of the impact region of the secondary electrons of the avalanche on the external face 60 is greater in the presence of the spacer 14 than in its absence. For example, the spacer 14 is arranged so that the distance between the horizontal plane containing the exits 44 and the external face 60 is greater than 10 μm or 15 μm and, generally, less than 300 μm or 200 μm.

The association of the cathode 4, of the dynode 6, of the grid 8, of the dynode 10 and of the grid 12 forms a device for amplification of electrical charges. More precisely, each time that an electron is generated by the cathode 4 and penetrates into one of the channels 24, the probability of it hitting the coating 32 is high, which, in response, leads to the generation on average of more than one secondary electron. These secondary electrons are in turn accelerated and again impact the coating 32 which multiplies the number of secondary electrons and causes what is referred to as an avalanche of secondary electrons. The secondary electrons penetrate inside of the channels 40 and the same phenomenon of multiplication of the secondary electrons occurs in these channels 40. Thus, each elementary particle that impacts the cathode 4 causes the generation of an avalanche of secondary electrons which is subsequently projected onto the external face 60 of the plate 16. The location of this avalanche of secondary electrons on the external face 60 is representative of the position of the point of impact of the elementary particle on the cathode 4. It is therefore necessary to determine the location of the avalanche of secondary electrons in order to be able to deduce from this the position of this point of impact. The plate 16 notably allows the location of this avalanche of secondary electrons in a horizontal plane to be determined.

For this purpose, the plate 16 notably comprises:

- a substrate 61 whose upper face forms the external face 60, and
- conducting strips 62 which extend horizontally on the external face 60.

Each strip 62 is electrically isolated from the other conducting strips 62 present in the plate 16. Each strip 62 extends mainly horizontally from a distal end to a proximal end. The distal and proximal ends of each strip 62 are situated on an edge of the plate 16. The arrangement of the strips 62 is described in more detail with reference to FIGS. 8 and 9.

Figure 5:
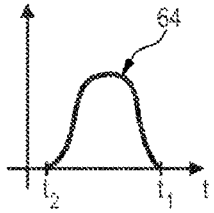
FIG. 5 is a schematic illustration of a charge peak able to be measured by a reader plate of the detector in FIG. 1.
Figure 6:
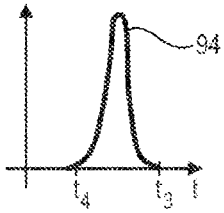
FIG. 6 is a schematic illustration of a charge peak able to be measured on a conducting grid of the detector in FIG. 1.

Since the strips 62 are situated on the external face 60, they are directly exposed to the secondary electrons of each avalanche. Thus, when the electrons of an avalanche reach a strip 62, this generates a characteristic charge peak on this strip. Such a charge peak 64 is schematically represented on the graph in FIG. 5. On this graph, and also on the graph in FIG. 6, the abscissa axis represents time and the ordinate axis represents the quantities of electrical charges. This peak 64 begins at a time $t_1$ and ends at a time $t_2$. The times $t_1$ and $t_2$ correspond to times when the quantity of charges on the strip 62, respectively, exceed and fall back below a predetermined threshold. This is because the secondary electrons of the same avalanche do not all arrive at the same time and at the same place on the strip 62 since they have not all followed the same path.

In order to detect or measure such charge peaks, each strip 62 is connected to a respective input of a sensor 70 of electrical charges. For this purpose, the detector 2 comprises an assembly 72 of sensors which comprises at least as many sensors 70 as there are strips 62.

In order to simplify FIG. 1, only one conducting strip 62 and only one sensor 70 are shown.

The sensor 70 is capable of measuring a physical quantity representative of the quantity of electrical charges present on the strip 62 to which it is connected. In this embodiment, the sensor 70 makes a fast measurement of the quantity of electrical charges present on this conducting strip 62. The measurement of the quantity of electrical charges on a strip may consist in:

- indicating the exceeding of the predetermined threshold by the quantity of electrical charges for as long as this threshold is exceeded, or
- systematically generating an electrical quantity representative of the quantity of electrical charges currently present on the conducting strip.

The detector 2 also comprises a processing unit 80 connected to each of the sensors 70. The processing unit 80 is capable of acquiring the measurements from the sensors 70. Subsequently, based on the measurements from the sensors 70 and on the known arrangement of the conducting strips 62, the unit 80 automatically determines the location of the second avalanche of secondary electrons. Using the location of the second avalanche, the unit 80 establishes the position of the point of impact between the elementary particle and the cathode 4. For this purpose, the processing unit 80 comprises:

a memory 82, and a programmable microprocessor 84 capable of executing instructions recorded in the memory 82.

Figure 10:
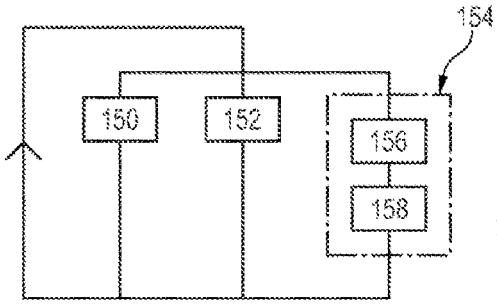
FIG. 10 is a flow diagram of a method for detecting elementary particles by means of the detector in FIG. 1.

The memory 82 comprises the instructions and the data needed for the execution of the method in FIG. 10.

Figure 7:
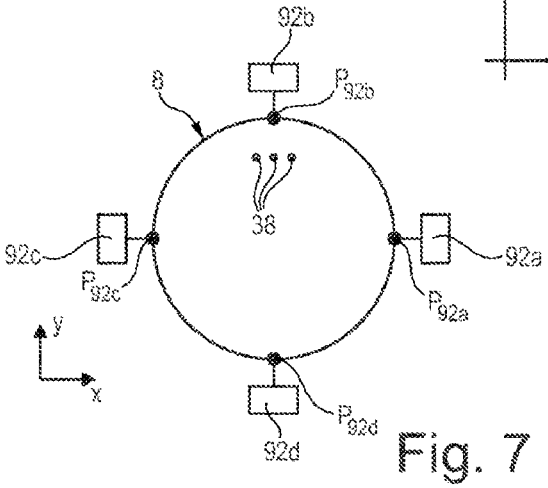
FIG. 7 is a schematic top view illustration of a conducting grid of the detector in FIG. 1.

Lastly, the detector 2 comprises an assembly 90 of one or more sensors 92 each capable of measuring a time at which the avalanche of secondary electrons crosses the grid 8. In the following, this time is called "crossing time". Here, each of these sensors is electrically connected to the grid 8. The assembly 90 here comprises four sensors 92 individually denoted by the references 92*a* to 92*d* in FIG. 7. In order to simplify FIG. 1, only one of these sensors 92 is shown in this figure. In this first embodiment, each sensor is for example connected to a respective point on the periphery of the grid 8. The connection points of the sensors 92*a* to 92*d* are respectively denoted $P_{92a}$ to $P_{92d}$. Here, these points $P_{92a}$ to $P_{92d}$ are uniformly distributed over the periphery of the grid 8.

Each sensor 92 is able to measure the characteristic electrical signal which appears when the grid 8 is traversed by an avalanche of secondary electrons. More precisely, when an avalanche of secondary electrons passes through the grid 8, this causes, by electromagnetic induction, the appearance of a charge peak in the grid 8. Such a charge peak 94 is shown on the graph in FIG. 6. The peak 94 begins at a time $t_3$ and ends at a time $t_4$. For example, the times $t_3$ and to are the times when the quantity of electrical charges measured by the sensor 92, respectively, exceeds then falls below a predetermined threshold. It will be noted that the peak 94 is much narrower than the peak 64 and that therefore the times $t_3$ and to are closer to one another than the times $t_1$ and $t_2$. Indeed:

the impedance of the grid 8 is much more uniform than the impedance of the conducting strips 62, and at the moment when the avalanche of secondary electrons crosses the grid 8, the secondary electrons are less spatially dispersed than at the time when this avalanche hits the plate 16.

On the other hand, the quantity of secondary electrons at the grid 8 is less.

The unit 80 is also connected to each of the sensors 92 in order to determine a time $t_a$ of arrival of the elementary particle using the measurements from the sensors 92.

Figure 8:
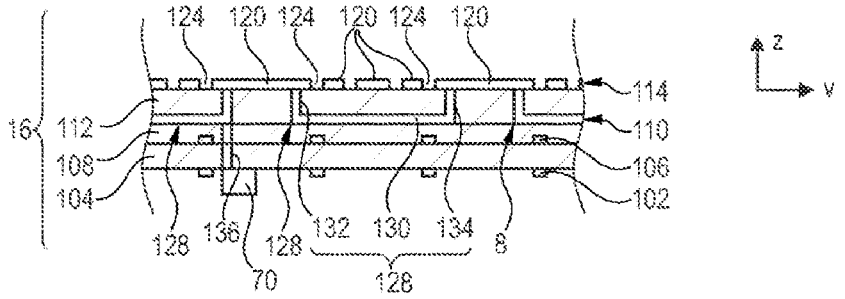
FIG. 8 is a partial schematic illustration, as a vertical cross section, of a reader plate of the detector in FIG. 1.

FIG. 8 shows the plate 16 as a vertical cross section along a horizontal direction V. The substrate 61 here is formed of a stacking, one immediately on top of the other, of horizontal layers. These stacked horizontal layers are the following, going from bottom to top in the direction Z:

a lower metallization layer 102, a first dielectric layer 104, a first intermediate metallization layer 106, a second dielectric layer 108, a second intermediate metallization layer 110, a third dielectric layer 112, and an upper metallization layer 114 deposited on the front face of the dielectric layer 112.

The term "dielectric layer" denotes a horizontal layer of which 90% of the volume is made of a dielectric material.

For example, the metallization layers are made of copper.

As is described in more detail with reference to FIG. 9, the metallization layer 114 is structured so as to form horizontal tiles 120 mechanically separated horizontally from one another by voids 124. In this text, the reference 120 is used as a generic reference to denote all the tiles formed in the layer 114. Each tile 120 is completely surrounded by a void 124. The voids 124 are filled with a dielectric material, for example, identical to that of the dielectric layer 112. Thus, there is no electrical connection, formed in the layer 114, which electrically connects two tiles 120 together. Here, the tiles 120 are all identical to one another. In particular, each tile 120 is derived from another tile 120 solely by a horizontal translation which may be combined with a rotation about a vertical axis. Each tile has the shape of a polygon whose sides have the same length.

The largest dimension of a tile 120 is chosen so that each avalanche of secondary electrons which encounters the plate 16 impacts at least two, and in this embodiment, at least three tiles 120 belonging to different conducting strips 62. For this purpose, the largest dimension of a tile 120 is preferably less than or equal to 5*Dm40 or 3*Dm40 and, advantageously, less than Dm40 or 0.5Dm40. The term "largest dimension of a tile" here denotes the length of the largest side of the horizontal rectangle with the smallest surface area which entirely contains the tile 120. The term "smallest dimension of a tile" denotes the length of the small side of this rectangle. The smallest dimension of a tile 120 is typically greater than 0.01*Dm40 or 0.1*Dm40 or 0.3*Dm40.

In order to form a conducting strip 62 which mainly extends along a horizontal line 126 (FIG. 9) parallel to the direction V, tiles situated behind one another along this line 126 are electrically connected together in series by means of electrical connections 128. The connections 128 are formed under the front face of the dielectric layer 112. Here, each connection 128 which electrically connects a first and a second tile 120 along the line 126 comprises:

a conducting track 130 formed in one of the metallization layers 102, 106, or 110 and which extends horizontally between a first end situated under the first tile 120 and a second end situated under the second tile 120, and vertical conducting plugs 132, 134, known by the term "via", which each pass through one or more of the layers 104, 108 and 112 for electrically connecting the first and second tiles, respectively, to the first and second ends of the track 130.

Here, in the particular case of the tiles 120 aligned along the line 126, the track 130 is formed in the metallization layer 110. The vias 132, 134 therefore only pass through the dielectric layer 112. The metallization layers 102 and 106 are used to form the electrical tracks, corresponding to the track 130, for the conducting strips 62 which extend, respectively, parallel to other directions U and W. Here, the direction V is parallel to the direction Y and the directions U and W are angularly rotated, respectively, by 60° and 120° with respect to the direction V.

In addition to the vias 132 and 134, each conducting strip comprises at least one additional via 136 which comes out on the lower face of the layer 104 and which allows this strip to be connected to a respective sensor 70. The via 136 extends, for example, from one of the connections 128 to this lower face of the layer 104. Accordingly, the sensor 70 which measures the quantity of electrical charges present on this strip 62 may be placed anywhere on this lower face and not only on the periphery of the plate 16.

Figure 9:
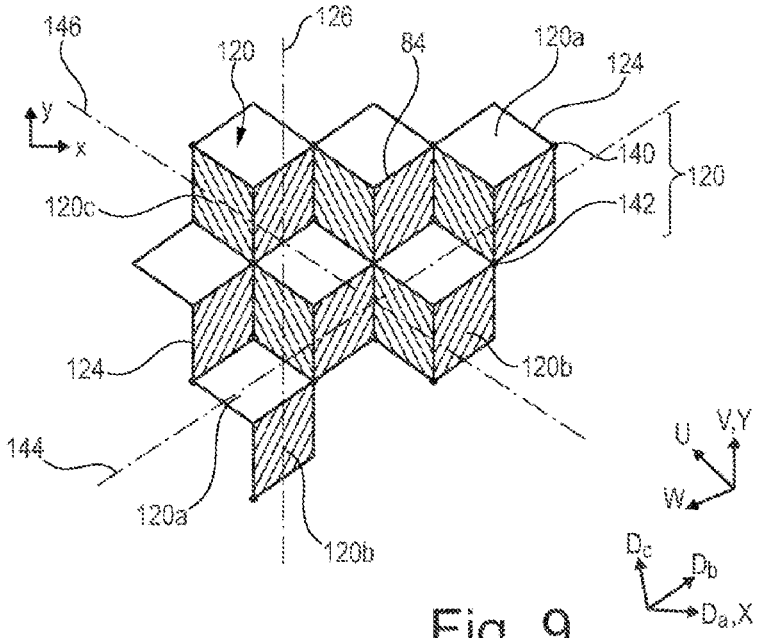
FIG. 9 is a partial schematic illustration, as a top view, of the arrangement of various electrodes, with respect to one another, of the reader plate in FIG. 8.

FIG. 9 shows a first example of a possible arrangement, with respect to one another, of the tiles 120 on the horizontal front face of the dielectric layer 112. In this embodiment, each tile 120 has the shape of a diamond whose two most pointed apices 140, 142 are situated at each end of the big diagonal of this diamond. The angle at the apices 140 and 142 is equal to 60°.

In FIG. 9, the voids 124 between the tiles 120 are represented by lines.

The tiles 120 are arranged with respect to one another in such a manner as to form a tessellation of the front face of the dielectric layer 112. Here, the tiles 120 are distributed over the front face of the dielectric layer 112 in such a manner as to form a periodic tessellation, in other words a tessellation which may be entirely constructed by periodically repeating the same pattern in at least two different horizontal directions. For example, here, the repeated pattern is a hexagon formed by three adjacent tiles 120 which carry, respectively, the numerical references 120*a*, 120*b* and 120*c* in FIG. 9. The big diagonals of these tiles 120*a*, 120*b* and 120*c* are, respectively, parallel to directions Da, db and Dc. The direction Da is parallel to the direction X and the directions db and Dc are angularly rotated, respectively, by +60° and +120° with respect to the direction Da. In the repeated pattern, these three tiles 120*a*, 120*b* and 120*c* have a common apex. In the case of the tessellation in FIG. 9, the pattern is periodically repeated in the directions Da, db and Dc.

In FIG. 9, in order to facilitate the identification of the tiles 120*a*, 120*b* and 120*c*, each tile 120*a*, 120*b* and 120*c* is filled with a respective texture.

All the tiles 120*b* whose big diagonals are aligned on the line 126 are electrically connected in series with one another starting from one edge of the tessellation up to the opposite edge so as to form a conducting strip 62 which extends parallel to the direction V. By thus connecting the tiles 120*b* aligned along the line 126, each tile 120*b* is separated from the tile 120*b* immediately consecutive along the line 126 by tiles 120*a* and 120*c*. Accordingly, the precision of the measurement of the position of the elementary particle is increased. The other tiles 120*b* are electrically connected together in a similar manner so as to form a plurality of conducting strips 62 which extend parallel to the direction Y. The various conducting strips 62 parallel to the direction Y thus formed are electrically isolated from one another.

In a similar manner, the tiles 120*a* whose big diagonals are aligned one after the other along a line 144 parallel to the direction W are all electrically connected in series with one another by connections 128. By proceeding thus for all the tiles 120*a*, a plurality of conducting strips 62 is formed that are electrically isolated from one another and all parallel to the direction U.

Lastly, again in a similar manner to what has been described for the tiles 120*a* and 120*b*, the tiles 120*c* aligned one behind the other along the same line 146 parallel to the direction U are electrically connected in series with one another by connections 128. By proceeding thus for all the tiles 120*c*, a plurality of conducting strips 62 is formed that are electrically isolated from one another and all parallel to the direction U.

When the dimensions of the tiles 120 are large enough, the latter may be etched into the metallization layer 114 using simple etching methods such as photolithography. When the dimensions of the tiles 120 are very small, it is possible to fabricate them using the same fabrication methods as those implemented for connecting together electronic components formed on a silicon substrate. Typically, these are the methods implemented during the phase of fabrication denoted by the acronym BEOL (for "Back End Of Line"). The metallization layers used to form the tiles 120 and their connections 128 are then, for example, chosen within the metallization level known by the acronyms M1 to M8.

Given that the charges of the avalanche are systematically spread over at least three contiguous tiles 120, the avalanche causes a variation of the electrical charge of at least three conducting strips 62 which each extend in three different directions. Thus, even if two avalanches encounter the plate 16 simultaneously at two different places, the processing unit 80 is capable of determining without ambiguity the positions of the two points of simultaneous impact if they are separated from one another by a distance greater than the largest dimension of a tile.

Here, the sensitivity of each conducting strip 62 is identical to that of the other conducting strips 62. Thus, it is not necessary to provide in the plate 16 means for compensating any difference in sensitivity between the various conducting strips 62.

Lastly, the number of sensors 70 needed for measuring the position of the point of impact of an elementary particle is much smaller than in the case where each tile 120 is electrically isolated from all the other tiles 120 and directly connected to an input of a respective sensor 70. Indeed, in the latter case, the assembly 72 must comprise as many sensors 70 as tiles 120, whereas in the embodiment described here, it only comprises one sensor 70 per conducting strip 62.

The operation of the detector 2 will now be described by means of the method in FIG. 10.

During a step 150, a photon impacts the cathode 4 and, in response, the cathode 4 generates at least one electron which penetrates inside of the channel 24 nearest to the point of impact. This electron is then accelerated and impacts the coating 32 thus resulting in the generation of a first avalanche of secondary electrons.

The first avalanche of secondary electrons passes through the grid 8, thus generating a charge peak, such as the peak 94. The electrons of this first avalanche penetrate inside of several of the channels 40. These electrons are then once again amplified inside of the channels 40. A second avalanche of secondary electrons is thus produced at the exit of the dynode 10 containing many more electrons than the first avalanche of secondary electrons.

The second avalanche passes through the grid 12 and the empty space 56 and the secondary electrons of this second avalanche, then impact several of the tiles 120 of the plate 16. This then generates a charge peak, such as the peak 64, on several of the conducting strips 62.

In parallel, during a step 152, the sensors 70 continually measure the quantity of electrical charges present on each of the strips 62 and transmit these measurements to the unit 80. At the same time, the sensors 92 continually measure the quantity of electrical charges present on the grid 8 and transmit these measurements to the unit 80.

During a step 154, for example executed in parallel with the step 152, the unit 80 processes the measurements of the sensors 70 and 92 in order to establish, during an operation 156, the position Pf of the point of impact of the photon on the cathode 4 and, during an operation 158, the time $t_a$ of arrival of this photon.

During the operation 156, a location P701 is firstly determined from the crossing points between the conducting strips 62 on which a charge peak has been detected. The distribution area of the charges of the secondary electrons of the second avalanche over the external face 60 is located at the intersection of several strips 62 on which a charge peak is detected. Since the location of the strips 62 is known in a plane X, Y, the location of this distribution area in the plane X, Y may be determined. For example, for this purpose, the memory 82 comprises a mapping of the strips 62 coding, for each of these strips, the equation of the horizontal axis along which it extends. The coordinates in the plane X, Y of the point of intersection between two strips 62 may then be easily found, since the equation of the axes of these strips is known.

In this embodiment, by way of illustration, during the operation 156, the measurements from the sensors 92 are additionally used for validating or invalidating the location P701 determined from the measurements of the sensors 70.

For example, for this purpose, the unit 80 calculates the difference $Ee_{a-b}$. The difference $Ee_{a-b}$ is equal to the estimation of the difference between the times $tm_{92a}$ and $tm_{92b}$ when the charge peak is detected by the sensors 92*a* and 92*b*, respectively. This difference $Ee_{a-b}$ is, for example, estimated by means of the following relationship: $Ee_{a-b}=(d_{92a}-d_{92b})/c_8$, where $d_{92a}$ and $d_{92b}$ are the distances that separate the location P701 determined from the locations, respectively, of the sensors 92*a* and 92*b*, and $c_8$ is the speed of propagation of the electrical signal in the grid 8.

The locations of the sensors 92*a* and 92*b* in the plane X, Y are known and, for example, stored in the memory 82.

The difference $Ee_{a-b}$ is subsequently compared with the measured difference $Em_{a-b}$. The difference $Em_{a-b}$ is equal to the difference $tm_{92a}-tm_{92b}$, where the times $tm_{92a}$ and $tm_{92b}$ are the measured times when the sensors 92*a* and 92*b*, respectively, detect the charge peak.

If the difference, in absolute value, between the differences $Ee_{a-b}$ and $Em_{a-b}$ is greater than a threshold S1, then the location P701 is considered as invalid. In the opposite case, it is considered as valid.

The verification of the validity of the location P701 is tested, as described hereinabove, in the particular case of the sensors 92*a* and 92*b*, using successively the others possible pairs of sensors 92. If the location P701 determined is validated with the measurements from each of the sensors 92, then the location P701 is considered as valid. For example, in this case, the position Pf of the point of impact is taken as equal to this location P701. In the opposite case, the location P701 is considered as invalid. In the latter case, the method stops and returns to an initial state for determining the position of the point of impact of the next elementary particle received.

Subsequently, during the operation 158, the unit 80 establishes the time $t_a$ of arrival of the elementary particle. For this purpose, in this embodiment, a time $t_{a92}$ of arrival of the elementary particle is determined using the measurements from the sensors 92. For this purpose, the unit 80 measures the times $tm_{92a}$, $tm_{92b}$, $tm_{92c}$ and $tm_{92d}$ when the sensors 92*a*, 92*b*, 92*c* and 92*d*, respectively, have detected a charge peak, such as the peak 94. For example, each of these times $tm_{92}$ is established based on the times corresponding to the times $t_3$ and to of the peak 94.

Subsequently, each of these times $tm_{92a}$ to $tm_{92d}$ is corrected by subtracting from them the time of propagation of the electrical signal between the location where the first avalanche passes through the grid 8 and the location of the sensor 92. In the following, the corrected times $tm_{92a}$ to $tm_{92d}$ are denoted $tc_{92a}$ to $tc_{92d}$.

For example, the time $tc_{92a}$ is calculated by means of the following relationship: $tc_{92a}=tm_{92a}-d_{92a}/c_8$, where:

$c_8$ is the speed of propagation of the electrical signal in the grid 8, and $d_{92a}$ is the distance between the location where the first avalanche crosses the grid 8 and the location of the sensor 92*a*.

The location where the first avalanche crosses the grid 8 is established based on the position Pf determined during the operation 156. For example, the coordinates of this location are taken equal to the coordinates x,y of the position Pf. The coordinates of the sensor 92*a* in the plane X, Y are known and, for example, pre-recorded in the memory 82.

The other corrected times $tc_{92b}$, $tc_{92b}$ and $tc_{92d}$ are typically calculated in a similar manner, but by replacing the distance $d_{92a}$ by the appropriate distance.

The time of arrival $t_{a92}$ of the elementary particle is then determined based on the corrected times $tc_{92a}$ to $tc_{92d}$. For example, the time $t_{a92}$ is equal to the arithmetic mean of the times $tc_{92a}$ to $tc_{92d}$. Here, the time $t_a$ of arrival of the elementary particle is for example taken equal to the time $t_{a92}$ thus determined.

Figure 11:
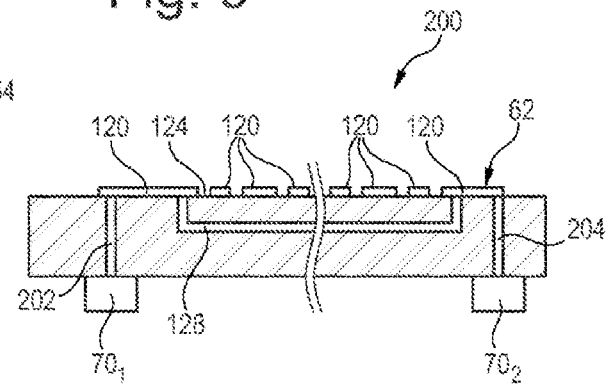
FIG. 11 is a partial schematic illustration, as a vertical cross section, of another embodiment of a reader plate.

FIG. 11 shows a reader plate 200 able to be used in place of the plate 16. This plate 200 is identical to the plate 16, except that two sensors $70_1$ and $70_2$ are connected to each end of each conducting strip 62. In order to simplify FIG. 11, only one strip 62 is shown. The wavy vertical lines indicate that a central part of the plate 200 has not been shown in FIG. 11. The via 136 is replaced by two vias 202 and 204, each situated at a respective end of the strip 62. The sensors $70_1$ and $70_2$ are connected, respectively, to the vias 202 and 204. Each of the sensors $70_1$ and $70_2$ is identical to the sensor 70.

Figure 12:
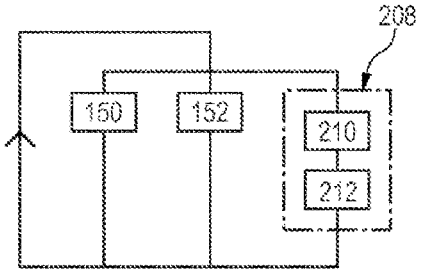
FIG. 12 is a flow diagram of a method for detecting elementary particles using the reader plate in FIG. 11.

The operation of a detector equipped with the plate 200 will now be described with reference to the method in FIG. 12. The method in FIG. 12 is identical to the method in FIG. 10, except that the step 154 is replaced by a step 208. The step 208 comprises successively:

an operation 210 for establishment of the position Pf of the point of impact, and an operation 212 for establishment of the time $t_a$ of arrival of the elementary particle.

The operation 212 is identical to the operation 156, except that it comprises, in addition to or in place of, the determination of a location P702 of the second avalanche of secondary electrons using the times $tm_{701}$ and $tm_{702}$ where the sensors $70_1$ and $70_2$ detect the presence of a charge peak, such as the peak 64. For example, each time $tm_{701}$ and $tm_{702}$ is determined using the times corresponding to the times $t_1$ and $t_2$ of the peak 64. For at least one of the strips 62 encountered by the second avalanche, the location P702 along this strip 62 is determined from the coordinates $xc_{62}$, $yc_{62}$ of the mid-point situated halfway between the sensors $70_1$ and $70_2$ and from the times $tm_{701}$ and $tm_{702}$. For example, the coordinates $x_{2i}$, $y_{2i}$ of the location P702 are taken equal to the coordinates $xc_{62}$, $yc_{62}$ to which the distance $(tm_{701}-tm_{702})*c_{16}$ is added, where $c_{16}$ is the speed of propagation of the electrical signal within the strip 62. Indeed, the times $tm_{701}$ and $tm_{702}$ are only equal if the second avalanche is situated on the mid-point. In all the other cases, in other words whenever the second avalanche is off-center with respect to the mid-point, the times $tm_{701}$ and $tm_{702}$ are different. The difference between the times $tm_{701}$ and $tm_{702}$ is proportional to the offset of the second avalanche with respect to the mid-point.

The calculation hereinabove is, preferably, carried out for several of the strips 62 on which a charge peak is detected. For each of these strips 62, a location P702 is obtained. These various locations P702 are then combined in order to obtain more precise coordinates $x_{2i}$, $y_{2i}$.

If coordinates of the location P701 have been determined from the crossing points of the conducting strips 62 on which a charge peak has been detected, advantageously, the latter are combined with the coordinates $x_{2i}$, $y_{2i}$ in order to obtain more precise coordinates of the second avalanche. For example, the coordinates of the second avalanche are obtained by performing an arithmetic or weighted average of the coordinates and $x_{2i}$, $y_{2i}$. For example, the weight allocated to the coordinates $x_{2i}$, $y_{2i}$ is less than that allocated to the coordinates Subsequently, for example, the coordinates x,y of the position Pf of the point of impact are taken as equal to the more precise coordinates thus determined.

The operation 212 is identical to the operation 158, except that it comprises, in addition to or instead of, the determination of a time $t_{a70}$ of arrival based on the measurements from the sensors $\mathbf{70}_1$ and $\mathbf{70}_2$ connected to a strip 62 encountered by the second avalanche of secondary electrons.

For example, for this strip 62, each time $tm_{701}$ and $tm_{702}$ is firstly corrected by subtracting the propagation time of the electrical signal between the location of the second avalanche and the location of each of the sensors $\mathbf{70}_1$ and $\mathbf{70}_2$. For this purpose, the coordinates of the location where the second avalanche encounters the plate 16 are established using the coordinates of the position Pf determined during the operation 210. The coordinates of each of the sensors $\mathbf{70}_1$ and $\mathbf{70}_2$ in the plane X, Y are known and, for example, pre-recorded in the memory 82. For example, a time $tc_{701}$ corrected for the time $tm_{701}$ is calculated by means of the following relationship $tc_{701}=tm_{701}-d_{701}/c_{16}$, where $d_{701}$ is the distance between the coordinates of the second avalanche along the strip 62 and the coordinates of the sensor $\mathbf{70}_1$ in the plane X, Y.

The corrected time $tc_{702}$ is calculated in a similar manner by replacing the coordinates of the sensor $\mathbf{70}_1$ with the coordinates of the sensor $\mathbf{70}_2$.

The time $t_{a70}$ is then obtained by combining the times $tc_{701}$ and $tc_{702}$ calculated for the various strips 62 on which a charge peak has been detected. For example, the time $t_{a70}$ is the arithmetic average of both the calculated times $tc_{701}$ and $tc_{702}$. When the times $t_{a70}$ and $t_{a92}$ are both determined, the time of arrival $t_a$ is obtained by combining these two times $t_{a70}$ and $t_{a92}$. For example, in one simple embodiment, the time $t_a$ is equal to the arithmetic average of the times $t_{a70}$ and $t_{a92}$.

Figure 13:
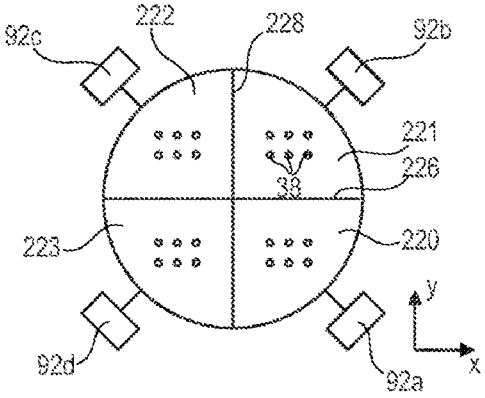
FIG. 13 is a schematic illustration, as a top view, of another embodiment of a conducting grid for the detector in FIG. 1.

FIG. 13 shows four conducting grids 220 to 223 able to be used in place of the grid 8. Here, the grids 220 to 223 each extend in the same horizontal plane as the horizontal plane in which the grid 8 extends. These grids 220 to 223 are arranged and arranged next to one another, in such a manner as to occupy the same surface area as the grid 8. The grids 220 to 223 are electrically isolated from one another. For this purpose, here they are electrically isolated from one another by two horizontal separations 226 and 228 respectively parallel to the directions X and Y. Thus, each grid 220 to 223 corresponds to a quarter of a disk. Each grid 220 to 223 is connected to a respective sensor 92. Here, the grids 220 to 223 are respectively connected to the sensors 92*a* to 92*d*. For example, the grids 220 to 223 are identical to the grid 8, except that each of them occupies a respective part of the surface through which the first avalanche of secondary electrons is able to pass. In particular, each of the grids 220 to 223 is connected to the terminal 36.

The operation of a detector in which the grid 8 is replaced by the grids 220 to 223 can be deduced from the explanations previously given. This detector is, in addition, capable of distinguishing, using the measurements from the sensors 92*a* to 92*d*, two elementary particles which arrive at the same time on the cathode 4, as long as each of these elementary particles triggers an avalanche of secondary electrons which passes through a respective grid from amongst the grids 220 to 223.

Figure 14:
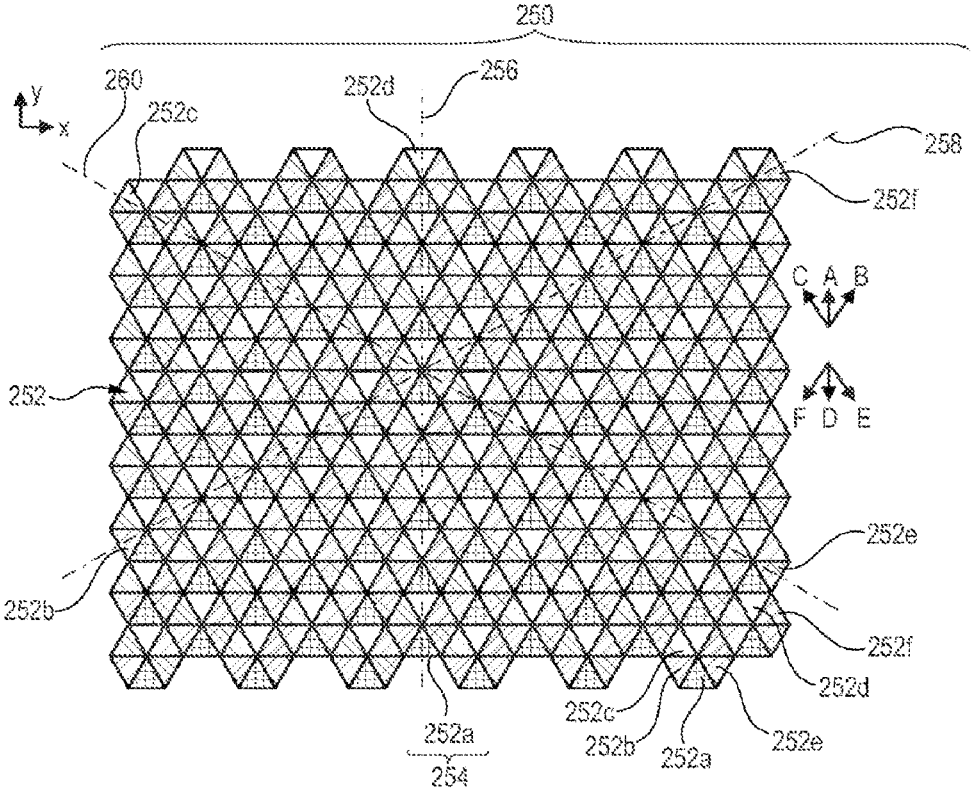
FIG. 14 is a partial schematic illustration, as a top view, of another arrangement of the various electrodes of the reader plate.

FIG. 14 shows a reader plate 250 identical to the plate 16 except that the tiles 120 are replaced by tiles 252. The tiles 252 are identical to the tiles 120 except that they each have a triangular shape. More precisely, each tile 252 is an equilateral or isosceles triangle. In this embodiment, the tiles 252 are electrically connected to one another in such a manner as to form conducting strips 254 which extend parallel to six directions A, B, C, D, E and F. The directions A and D are parallel to the direction Y. The directions B and E are respectively angularly offset by −60° with respect to the directions A and D. The directions C and E are respectively angularly offset by +60° with respect to the directions A and D.

In FIG. 14, the numerical references 252*a*, 252*b*, 252*c*, 252*d*, 252*e* and 252*f* are used to denote the tiles 252 which belong to conducting strips parallel, respectively, to the directions A, B, C, D, E and F. In order to simplify FIG. 14, each tile that belongs to the conducting strips which extend parallel to a predetermined direction is filled with a respective texture, which allows this tile to be identified in the plate 250, even without a numerical reference. In the tessellation in FIG. 14, the periodically repeated pattern is a hexagon comprising one copy of each of the tiles 252*a*, 252*b*, 252*c*, 252*d*, 252*e* and 252*f*. In this pattern, these tiles 252*a*, 252*b*, 252*c*, 252*d*, 252*e* and 252*f* share a common apex situated on the geometric center of the hexagon. This hexagon is periodically repeated in the directions A, B and C.

The tiles 252*a* and 252*d* are aligned along lines parallel to the directions A and D such as the line 256. Along the line 256, a tile 252*d* is interposed between each pair of successive tiles 252*a*.

The tiles 252*b* and 252*f* are aligned along lines parallel to the directions B and F such as the line 258. Along the line 258, a tile 252*b* is interposed between each pair of successive tiles 252*f*.

The tiles 252*c* and 252*e* are aligned along lines parallel to the directions C and E such as the line 260. Along the line 260, a tile 252*c* is interposed between each pair of successive tiles 252*e*.

By virtue of this arrangement and this mutual connection of the tiles 252, each tile 252, which is not situated on an edge of the tessellation, is immediately surrounded by tiles 252 belonging to five different conducting strips. Accordingly, each point of impact results in a variation of the electrical charge on at least six different conducting strips. With the plate 250, it is therefore possible to determine, without ambiguity, the position of five simultaneous points of impact at least if the distance separating two of these points of impacts is greater than the largest dimension of the tile.

CHAPTER II. VARIANTS

Variants of the Dynodes

As a variant, the matrix 34 is made from the same material as the coating 32.

Many methods are possible for fabricating the coating 32. For example, the coating is obtained by a chemical reaction between the material which composes the matrix 34 and a chemical reagent. For example, this chemical reagent is a liquid or gaseous reagent introduced inside each of the channels. For example, the coating 32 is the result of an oxidation or of a nitridation of the matrix 34.

Other emissive materials are usable for forming the coating 32. For example, the coating 32 may also consist of one or more of the materials chosen within the group composed of the materials listed between the lines 41 and 44 of the column 10 of U.S. Pat. No. 6,384,519B1.

In another embodiment, the coating 32 does not cover the entirety of the walls of the channels. For example, the coating 32 is only situated on the upper part of the channels, whereas the lower part of these channels is lacking an emissive coating.

In another embodiment, the emissive material is a gas and the channels are filled with this gas. For example, the gas is a mixture of 90%, by weight, of argon and of 10%, by weight, of carbon dioxide. In this case, the coating 32 may be omitted.

The transverse cross section of the channels may have any given shape. For example, the transverse cross section of the channels may be a polygon, such as a square, or may be an oval.

The transverse cross section of the channels is not necessarily constant over the whole length of the channel. For example, the transverse cross section of the channel may decrease going toward its exit.

Many methods are possible for fabricating the channels. For example, the channels may be formed by anisotropic plasma etching, by photolithography or by another method.

The axis of the channels may be inclined with respect to the horizontal plane. If the detector comprises several dynodes stacked on top of one another, the axes of the channels of the upper dynode are, preferably, inclined along a first direction which intersects a second direction. The axes of the channels of the lower dynode are then parallel to this second direction.

In another embodiment, the channels do not extend along a rectilinear axis, but along a curved or winding path.

The dynode may be made of another material. For example, as a variant, the dynode is made of a resistive or dielectric or conducting material. For example, the material used to fabricate the dynode may be chosen within the group composed of the materials listed between the rows 6 and 17 of the column 10 in U.S. Pat. No. 6,384,519B1.

When the dynode is made of a dielectric material, the conductivity of the walls of the channels may be increased by depositing onto these walls a sub-layer of a resistive material such as, for example, a resistive polymer sub-layer. This sub-layer then forms the wall of the channel on which the emissive coating is formed.

Variant of the Reader Plate

When the sensors 70 are connected between the ends of the conducting strips, it is not necessary for the ends of each conducting strip to be situated on the edge of the reader plate. As a variant, the ends of at least some of the conducting strips are then situated between the edges of the reader plate.

The conducting strips may be replaced by conducting electrodes electrically isolated from one another and each individually connected to its own sensor 70 as described in U.S. Pat. No. 6,384,519B1.

As a variant, the conducting strips are rectilinear strips which extend in a single plane. There are therefore no tiles situated in a first horizontal plane and no electrical connections situated under this first horizontal plane. In this case, so that the conducting strips which extend in secant directions are able to intersect, they are formed in horizontal planes situated at various heights.

As a variant, a full and uniform resistive layer is deposited onto the external face 60 of the plate 16. Potentially, this resistive layer is separated from the conducting strips 62 by a layer of dielectric material. The surface or sheet resistivity of this resistive layer at 20° Celsius is in the range between 10 kΩ/□ and 100 MΩ/□. Preferably, the sheet resistivity is greater than 100 kΩ/□ or 1 MΩ/□ and, advantageously, less than 10 MΩ/□. By capacitive coupling between this resistive layer and the strips 62, the secondary electrons received on the resistive layer lead to a corresponding variation in the electrical charge on some of the strips 62. It is this variation in the electrical charge on the strips 62 which is measured by the sensors 70. This resistive layer allows the electrical charges to be spread over the external face 60.

In another variant, the substrate 61 comprises, in addition, ground planes extending horizontally between the metallization layers in order to reduce the crosstalk between the conducting strips.

Others Variants of the Detector

Elementary particles other than photons can be detected. For example, the elementary particle to be detected may be a charged particle, such as an ion or a muon, or a neutral particle such as a neutron. For this purpose, the cathode is then made of an emissive material which emits at least one electron when it is impacted by the elementary particle to be detected. The emissive material therefore depends on the elementary particle to be detected. For example, in order to detect a neutron, the emissive material used may be boron or palladium. It is also possible to detect protons by choosing the appropriate emissive material.

As a variant, the detector comprises a single dynode and a single conducting grid.

As a variant, a spacer may also be placed between the dynodes 6 and 10. This notably allows the spatial dispersion of the secondary electrons in various channels to be improved. For example, it is then possible to distribute the electrons coming out of the exit 30 of a single channel 24 into several channels 40 even if the diameter Dm40 of the channels 40 is greater than the diameter Dm24. Conversely, the spacer 14 may be omitted in certain embodiments such as the embodiments where the diameter Dm24 is greater than the diameter Dm40.

In one simplified embodiment, the detector comprises a single sensor 92. In this case, the combination of the times $tc_{92a}$ to $tc_{92d}$ is omitted.

Numerous different technologies exist for measuring a charge peak such as the peak 64 or 94. In particular, a capacitive or inductive measurement may be implemented. In those cases, the sensors 70 and 92 are not necessarily directly electrically connected, respectively, to a strip 62 and the grid 8.

When the detector comprises several dynodes and several conducting grids situated between these dynodes, one or more of these conducting grids are connected to sensors 92. For example, in one alternative embodiment, the sensors 92 are connected to the grid 12 instead of being connected to the grid 8. In this case, the quantity of electrical charges which pass through the grid 12 is larger but the spatial distribution of the electrons is then more spread out.

Other embodiments of the grids 220 to 223 are possible. For example, more than four grids may be used or, conversely, less than four grids. The shapes of the grids 220 to 223 may also be different.

As a variant, the sensors 70 are connected to the distal or proximal end of the conducting strips 62. In this case, the connections to the strips 62 are distributed over the periphery of the reader plate. It is not then necessary to provide a vertical via for connecting the sensors 70 to a central point of these strips 62.

Variants of the Method of Operation

As a variant, during the operation 210, the location P702 is not determined. For example, in this case, the position Pf of the point of impact is only established from the location P701.

In another variant, the location P701 is not determined. For example, in this case, the position Pf is established by using only the location P702 and without using the points of intersection between the conducting strips 62. In this case, it is not necessary for the conducting strips to intersect. For example, they may all be parallel to one another.

The validation, and alternately, the invalidation of the location P701 may be applied to the location P702. In another embodiment, the validation, and alternately, the invalidation of the location determined based on the measurements from the sensors 92 may be omitted.

During the operation 156, it is also possible to determine a location P92 where the first avalanche passes through the grid 8 based on the measurements from the sensors 92. More precisely, here the fact that there are several sensors 92 connected to the same grid 8 at different locations is exploited. The times of propagation of the electrical signal, generated by the first avalanche of secondary electrons which passes through the grid 8, to each of the sensors 92*a* to 92*d* are not then identical because the distances to be traveled are not the same. It is this difference between the propagation times which is exploited in order to determine the location P92 by triangulation. Since the determination of a location by triangulation is well known, the latter is not described in more detail here. Subsequently, the position Pf of the point of impact is established by combining the locations P701 and P92 or P702 and P92. For example, the position Pf is equal to the arithmetic average of the locations P701 and P92.

There are many ways of combining the locations P701, P702 and P92 in order to determine the position Pf of the point of impact. For example, a weighted average of the locations P701 and P92 may be used by preferably giving more weight to the location P701.

The determination of the time $t_{a92}$ based on the various corrected times $tc_{92a}$ to $tc_{92d}$ may be carried out other than by a simple arithmetic average. For example, the arithmetic average is replaced by a weighted average in which a greater weight is assigned to the sensors 92 that are nearest to the point of impact. In another embodiment, only the measurement or the measurements from the sensors 92 which are located at a distance less than a predetermined threshold from the point of impact are taken into account. In a similar manner, the time $t_{a70}$ may be calculated by implementing means other than a simple arithmetic average. For example, the various variants described in the particular case of the determination of the time $t_{a92}$ is also applicable the determination of the time $t_{a70}$.

Other embodiments than an arithmetic average of the times $t_{a70}$ and $t_{a92}$ are possible for establishing the time $t_a$. For example, the time $t_a$ is a weighted average of the times $t_{a70}$ and $t_{a92}$ giving greater weight to the time $t_{a92}$ than to the time $t_{a70}$.

In one simplified embodiment, the correction of the times $tm_{92}$ or $tm_{70}$ is omitted. For example, the time $t_{a92}$ or $t_{a70}$ is calculated directly based on the measurements from the sensors 92 or 70 but without using the position Pf of the point of impact. This embodiment is practical if the propagation times are negligible.

The calculation of the time $t_{a70}$ may be implemented even if only one sensor 70 is connected to each conducting strip 62.

In one variant, the time $t_{a70}$ is not determined and the measurements from the sensors 70 are not used to determine the time $t_a$.

As a variant, the time $t_{a92}$ is not determined. For example, the time $t_a$ is determined based only on the measurements from the sensors 70. By way of illustration, the time $t_a$ is then taken equal to the time $t_{a70}$. In this case, the sensors 92 may be omitted.

CHAPTER III. ADVANTAGES OF THE EMBODIMENTS DESCRIBED

After having passed through the conducting grid, the avalanche of secondary electrons spreads out. The impact region of the secondary electrons on the reader plate is therefore wider than the area of the conducting grid traversed by these same secondary electrons. In other words, the spatial dispersion of these secondary electrons is smaller at the conducting grid than at the reader plate. Since the spatial dispersion of these secondary electrons at the conducting grid is smaller, it generates a narrower charge peak. Moreover, the impedance of the conducting grid is much more uniform than the impedance of the conducting strips 62. Indeed, the impedance of the tiles 120 is different from the impedance of the connections 128 which creates many impedance discontinuities along each strip 62. Because of these two characteristics, the uncertainty on the time $t_a$ at which the elementary particle arrives is smaller if this time is established using the measurements from the sensors 92 than only using the measurements from the sensors 70.

Using the corrected times $tc_{92a}$ to $tc_{92d}$ allows the precision of the measurement of the time $t_a$ of arrival to be further increased.

Using several sensors 92 also allows the precision of the measurement of the time $t_a$ of arrival to be further increased.

Using several grids contiguous with one another in the same plane allows several elementary particles encountering the cathode 4 simultaneously to be distinguished. This then allows the time of arrival $t_a$ of these elementary particles to be determined in a more reliable manner.

Using the conducting strips instead of individual electrodes considerably reduces the number of sensors 70 needed to determine the position Pf of the point of impact. In addition, the tiles of each conducting strip are situated in the same plane such that they have the same sensitivity. It is not therefore necessary to implement means for correcting differences in sensitivity between the conducting strips, as is the case when these conducting strips are situated in different horizontal planes.

The fact that the largest dimension of the tiles is less than or equal to the largest dimension of the exit of the channels simply allows the avalanche of secondary electrons to be distributed over several tiles even in the case where the detector comprises only one dynode.

Connecting the sensor 70 to a central point going through the via 136 rather than to the ends of the strip 62 allows the sensors 70 to be accommodated under the strip 62. This facilitates the installation of the sensors 70 and hence the fabrication of the reader plate.

The fact that the exit of the channels of the dynode 6 covers, at least partially, several entries of the dynode 10 allows the avalanche of secondary electrons to be simply spread over a larger number of tiles, even if the largest dimension of these tiles is greater than the largest dimension of the transverse cross section of the exit of the channels directly facing these tiles. This allows the design and the fabrication of the reader plate to be simplified since the constraints on the dimensions of the tiles are reduced.

The fact that the transverse cross section of the entries 42 of the channels 40 of the lower dynode 10 is smaller than the transverse cross section of the exits 30 of the channels 24 of the dynode 6 allows the avalanche of secondary electrons to be simply spread out. In particular, this spreading occurs without it being, for this purpose, necessary to precisely position the dynode 6 with respect to the dynode 10.

The invention is of course applicable to the study of the physics of particles. The invention is also applicable to the field of imaging, notably in the space, medical or environmental fields and also the field of transport. For example, in the medical field, the invention may be used in the framework of hadron therapy or proton therapy treatment or also in the framework of positron emission therapy (PET).

The invention claimed is:

1. An elementary particle detector, said detector comprising:

a cathode and a conducting grid able to create a potential difference able to accelerate electrons in the direction of the conducting grid, the conducting grid being able to be traversed by the accelerated electrons;

a dynode interposed between the cathode and the conducting grid, said dynode being able, for each elementary particle, to produce an avalanche of secondary electrons, said dynode comprising for said purpose several channels, each channel comprising an emissive material, said emissive material being capable, in response to an impact of an electron, of generating, on average, more than one secondary electron;

a reader plate arranged on the side of the conducting grid opposite to the dynode, said reader plate comprising:

an external face arranged in such a manner as to be impacted by the avalanche of secondary electrons; and electrodes arranged next to one another in a face parallel to or coincident with the external face;

first sensors able to measure the quantity of electrical charges on the electrodes;

a processing unit capable of determining the location of the avalanche of electrons based on the quantity of electrical charges measured by the first sensors and on the known location of the electrodes;

the detector includes at least one second sensor, each said second sensor being able to measure an electrical signal produced by the secondary electrons when they pass through the conducting grid; and the processing unit is capable, in addition, of establishing a time of arrival of the elementary particle based on a time referred to as "crossing time" where the electrical signal is measured by said at least one second sensor.

2. The detector according to claim 1, in which the processing unit is configured for:

correcting the crossing time by subtracting from it a time for propagation of the electrical signal between the location where the conducting grid is traversed by the avalanche of secondary electrons and the location where the electrical signal is measured by said at least one second sensor, the location where the conducting grid is traversed by the avalanche of secondary electrons being established based on the measurements from the first sensors, then determining the time of arrival based on the corrected crossing time thus obtained.

3. The detector according to claim 2, in which the detector comprises several said second sensors situated at respective locations, spaced out from one another, and the processing unit is configured for determining the time of arrival using the corrected crossing times obtained based on the measurements from each of said second sensors.

4. The detector according to claim 1, in which the detector comprises:

several conducting grids arranged so as to be contiguous with one another in the same plane in order to cover the whole surface area able to be traversed by the avalanche of secondary electrons, said conducting grids being electrically isolated from one another, and said at least one second sensor associated with each of said conducting grids for measuring the electrical signal only in said conducting grid.

5. The detector according to claim 1, in which the reader plate comprises, in the order starting from its external face:

a dielectric layer having a front face turned toward the external face; and conducting strips forming the electrodes of the reader plate, said conducting strips extending mainly parallel to the front face in at least two different directions, each conducting strip being electrically connected to at least a first electrical charge sensor of said first sensors, said conducting strips being formed by:

conducting tiles all identical to one another and all situated at the same distance from the external face, said conducting tiles being distributed over the front face of the dielectric layer and being mechanically separated from one another by a dielectric material, and electrical connections, situated under the dielectric layer, which electrically connect conducting tiles in series in such a manner as to form said conducting strips, said electrical connections being arranged in such a manner that each conducting tile belongs to a single conducting strip and each side of a tile is adjacent to the side of another tile belonging to another conducting strip.

6. The detector according to claim 5, in which a largest dimension of each tile is less than or equal to a largest dimension of a transverse cross section of the exit of each channel directly facing the reader plate, the largest dimension of the transverse cross section of the exit of a channel and the largest dimension of a tile being equal to a length of a largest side of a rectangle with a smallest surface area which respectively entirely contains said transverse cross section and said tile.

7. The detector according to claim 5, in which:

at least one conducting strip extends from a first end to a second end; and the reader plate comprises at least one via which extends perpendicularly to its external face from a point situated between the ends of the conducting strip up to a point of electrical connection to a first sensor.

8. The detector according to claim 5, in which the detector comprises at least one upper dynode stacked onto a lower dynode, the lower dynode being arranged with respect to the upper dynode in such a manner that the secondary electrons coming out of a channel of the upper dynode are distributed into several channels of the lower dynode.

9. The detector according to claim 8, in which the diameter of the transverse cross section of the entries to the channels of the lower dynode is equal to or less than the diameter of the transverse cross section of the exits from the channels of the upper dynode.

10. A method for detecting an elementary particle by means of a detector according to claim 1, in which the method comprises:

the measurement of the quantity of electrical charges received by each electrode of the reader plate by means of the first sensor;

the determination of the location of the avalanche of secondary electrons based on the quantity of electrical charges measured by the first sensors and based on the known location of the electrodes;

the measurement of an electrical signal produced by the secondary electrons when they pass through the conducting grid by means of said at least one second sensor; and the establishment of a time of arrival of the elementary particle based on a time referred to as "crossing time" when the electrical signal is measured by the second sensor.

11. An information recording medium, readable by an electronic computer, said information recording medium comprises instructions for the execution of a method according to claim 10, when said instructions are executed by the electronic computer.

* * * * *